US008123566B2

(12) United States Patent
Liu et al.

(10) Patent No.: US 8,123,566 B2
(45) Date of Patent: Feb. 28, 2012

(54) ELECTRONIC DEVICE, ADAPTER AND RECEPTACLE

(75) Inventors: Chih-Yuan Liu, Hsinchu County (TW); Chien-Hong Lin, Hsinchu County (TW); Yi-Lun Wen, Taoyuan County (TW); Gilbert Sun, Taipei County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 12/909,850

(22) Filed: Oct. 22, 2010

(65) Prior Publication Data

US 2011/0217878 A1 Sep. 8, 2011

Related U.S. Application Data

(60) Provisional application No. 61/310,706, filed on Mar. 5, 2010.

(30) Foreign Application Priority Data

Jul. 22, 2010 (TW) ..... 99124178 A

(51) Int. Cl.
*H01R 24/00* (2011.01)

(52) U.S. Cl. ..... 439/630

(58) Field of Classification Search ..... 439/630–635, 439/637, 59–60, 55
See application file for complete search history.

(56) References Cited

U.S. PATENT DOCUMENTS

| | | | | |
|---|---|---|---|---|
| 6,854,984 | B1 | 2/2005 | Lee et al. | |
| 6,948,983 | B1 | 9/2005 | Peng | |
| 7,108,560 | B1 | 9/2006 | Chou et al. | |
| 7,364,090 | B2 | 4/2008 | Cuellar et al. | |
| 7,628,655 | B1 | 12/2009 | Chen | |
| 7,806,698 | B2 * | 10/2010 | Regnier | 439/37 |
| 2008/0218799 | A1 * | 9/2008 | Hiew et al. | 358/1.16 |
| 2009/0093136 | A1 * | 4/2009 | Hiew et al. | 439/55 |
| 2009/0181578 | A1 | 7/2009 | Chen et al. | |
| 2009/0227144 | A1 | 9/2009 | Ma | |

FOREIGN PATENT DOCUMENTS

CN 101316012 12/2008

* cited by examiner

*Primary Examiner* — Jean F Duverne
(74) *Attorney, Agent, or Firm* — Jianq Chyun IP Office

(57) ABSTRACT

An electronic device, an adapter and a receptacle are provided. The electronic device includes a card body, a plurality of first and second terminals, and at least one stub. The card body has a front edge, a first surface and a second surface opposite to the first surface. The first terminals are between the first terminals and the front edge. The stub is disposed on the second surface and near the front edge. The adapter includes a body and a plurality of elastic terminals. The body has an accommodating portion for accommodating an electronic device. One ends of the elastic terminals are fixed to the body. When the electronic device is accommodated at the accommodating portion, a plurality of flat terminals of the electronic device are outside of the accommodating portion, and another ends of the elastic terminals are against the flat terminals correspondingly.

22 Claims, 19 Drawing Sheets

ELECTRONIC DEVICE, ADAPTER AND RECEPTACLE

CROSS-REFERENCE TO RELATED APPLICATION

This application claims the priority benefit of U.S. provisional application Ser. No. 61/310,706, filed on Mar. 5, 2010 and Taiwan application serial no. 99124178, filed Jul. 20, 2010. The entirety of each of the above-mentioned patent applications is hereby incorporated by reference herein and made a part of specification.

BACKGROUND OF THE DISCLOSURE

1. Field of Invention

The disclosure relates to an electronic device, an adapter, and a receptacle, and more particularly to an electronic device, an adapter, and a receptacle adapted for a Universal Serial Bus (USB) specification.

2. Description of Related Art

Nowadays, more and more manufacturers are investing in thin card-related product development and manufacturing. USB thin card products include the common Bluetooth module and the Global Positioning System (GPS) module, as well as the thin memory card equipped with a flash memory. Currently, the standard USB male plug and female receptacle exhibit a reliable connectivity due to a metallic outer shell design. However, thin cards are not equipped with the metallic outer casing. Accordingly, when thin cards purchased on the market today are plugged into a female receptacle, shaking typically results and causes a poor signal contact phenomenon.

Referring to FIG. 1, a conventional receptacle 10 of the USB 3.0 specification has a cavity height H10 of approximately 2.56 mm, and a body thickness of a thin card 20 is approximately 2 mm. After the thin card 20 is plugged into the cavity of the receptacle 10, since the body thickness H12 of the thin card 20 is smaller than the cavity height H10 of the receptacle 10, the thin card 20 would shake and disorient by using a spring 12 of the receptacle 10 as a fulcrum. As shown by a region A10 in FIG. 1, a solid contact cannot be made between a terminal 22 and a terminal 14 of the thin card 20, thus causing a break in signal transmission. Moreover, as shown in FIG. 1, the terminal 22 of the USB 3.0 thin card 20 is a spring type. When storing or carrying the thin card 20, the terminal 22 protruding from a surface of the thin card body comes easily into collision or friction with external objects, thereby causing accidental damages. On the other hand, changing the terminal 22 of the thin card 20 into a planar shape would also cause a contact issue, since the terminal 14 of the receptacle 10 is also planar and cannot contact the terminal 22 of the thin card 20.

SUMMARY OF THE DISCLOSURE

An electronic device is introduced herein capable of avoiding disorientation when connecting with the receptacle and a poor contact.

An adapter is introduced herein capable of combining with the electronic device and enhancing a compatibility property.

An receptacle is introduced herein capable of being compatible with a plurality of USB electronic devices.

An electronic device is introduced herein, including a card body, a plurality of first terminals, and at least one stub. The card body has a front edge, a first surface, and a second surface opposite to the first surface. The first terminals are arranged on the first surface and near the front edge. The stub is disposed on the second surface and near the front edge.

Another electronic device is introduced herein, adapted for plugging into a cavity of a receptacle. The electronic device includes a card body and a plurality of first terminals. The card body has a front edge, a first surface, and a second surface opposite to the first surface. The second surface has at least one lock hole. The first terminals are arranged on the first surface and near the front edge. The receptacle has a plurality of third terminals and at least one orientation spring. The third terminals are disposed on a top wall of the cavity, and the orientation spring is disposed on a bottom wall of the cavity. When the orientation spring is correspondingly disposed on the locked hole, the first terminals correspondingly contact the third terminals.

An adapter is introduced herein, including a body and a plurality of elastic terminals. The body has an accommodating portion for accommodating an electronic device. One ends of the elastic springs are fixed to the body. When the electronic device is accommodated at the accommodating portion, a plurality of flat terminals are disposed outside of the accommodating portion, and another ends of the elastic terminals are against the flat terminals correspondingly.

An adapter is introduced herein, including a body, a plurality of elastic terminals, and a plurality of second elastic terminals. The body has a cavity. The first elastic terminals are arranged as a row on a top wall of the cavity. The second elastic terminals are arranged as a row on the top wall of the cavity, and the row with the second elastic terminals is not the same as the row with the first elastic terminals.

In summary, an electronic device according to an embodiment of the disclosure has a stub and/or a locked hole, thereby preventing disorientation and ensuring a reliable contact with the receptacle. An adapter according to an embodiment of the disclosure provides elastic terminals capable of enhancing a compatibility property of the electronic device. The receptacle according to an embodiment of the disclosure employs two types of elastic terminals, hence a preferable compatibility property is achieved.

Several exemplary embodiments accompanied with figures are described in detail below to further describe the disclosure in details.

BRIEF DESCRIPTION OF THE DRAWINGS

The accompanying drawings are included to provide a further understanding, and are incorporated in and constitute a part of this specification. The drawings illustrate exemplary embodiments and, together with the description, serve to explain the principles of the disclosure.

DESCRIPTION OF EMBODIMENTS

Figure 1:
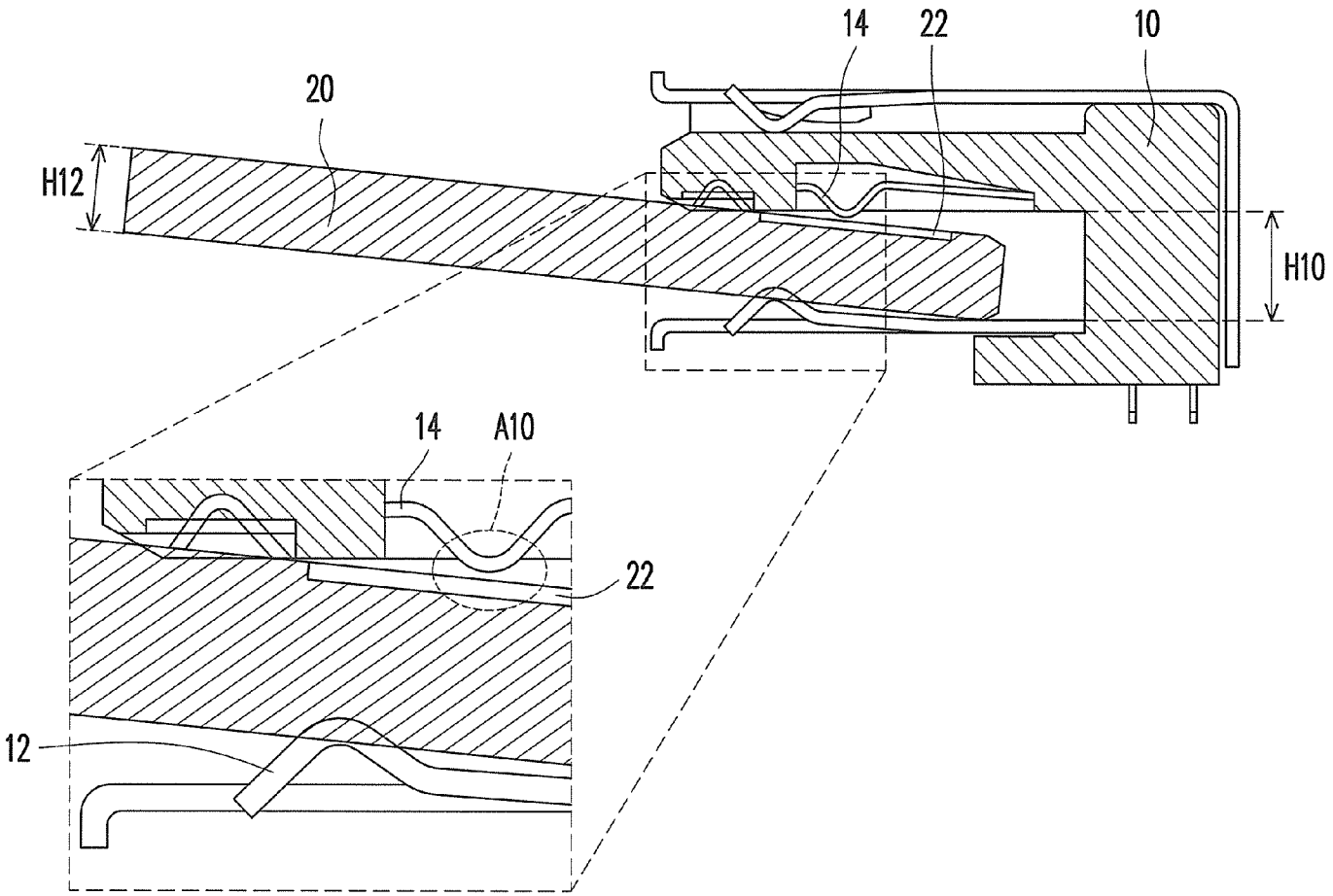
FIG. 1 (RELATED ART)
FIG. 1 is a schematic assembly view of a conventional thin card and a receptacle.
Figure 2:
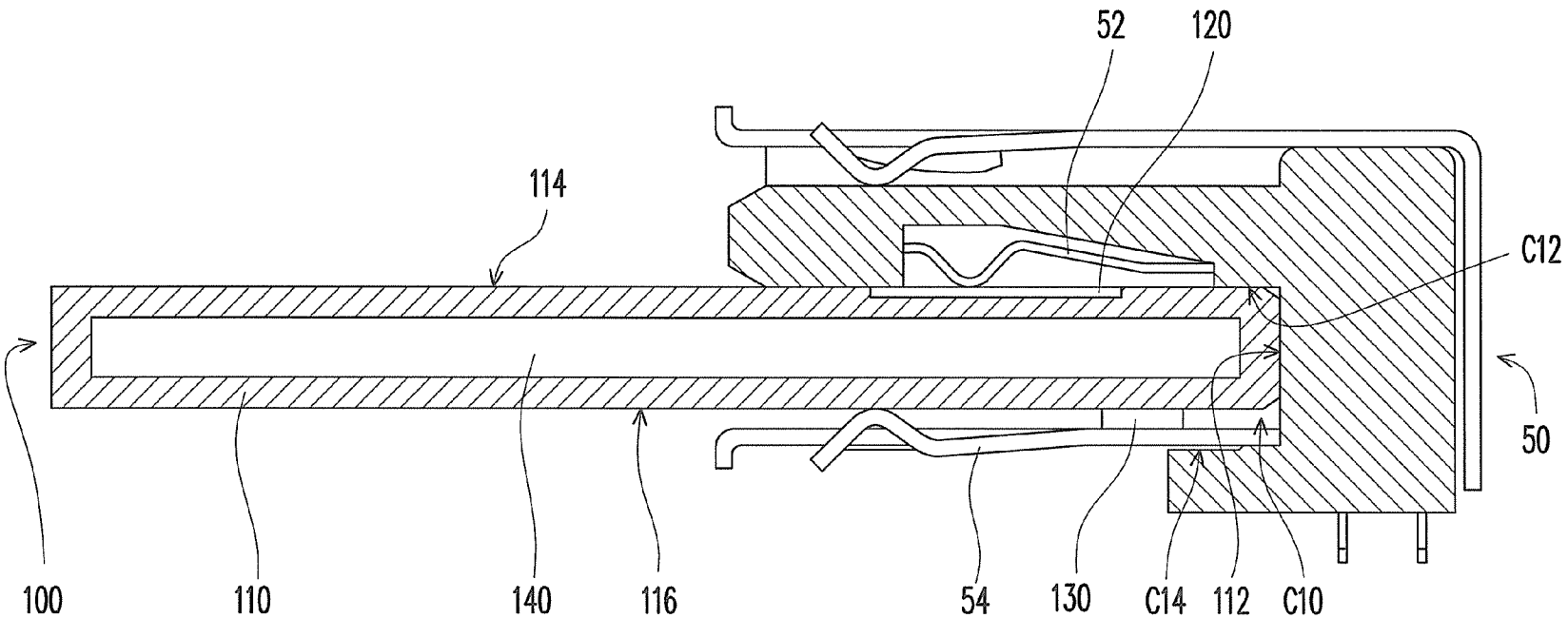
FIG. 2 is a schematic assembly view of an electronic device and a receptacle according to an exemplary embodiment of the disclosure.

FIG. 2 is a schematic assembly view of an electronic device and a receptacle according to an exemplary embodiment of the disclosure. Referring to FIG. 2, an embodiment provides an electronic device 100 including a card body 110, a plurality of terminals 120 (only one terminal 120 is depicted in FIG. 2), and at least one sub 130. The card body 110 has a front edge 112, a first surface 114, and a second surface 116 opposite to the first surface. The terminals 120 are arranged on the first surface 114 and near the front edge 112. The stub 130 is disposed on the second surface 116 and near the front edge 112. A receptacle 50 has a cavity C10. A top wall of the cavity C10 has a plurality of terminals 52 thereon. Moreover, a bottom wall C14 of the cavity C10 has at least one orientation spring 54 thereon, or the bottom wall C14 has no orientation spring 54 thereon. After the electronic device 100 is plugged into the cavity C10 of the receptacle 50, the bottom wall C14 of the cavity C10 can contact the stub 130 of the electronic device 100, and the orientation spring 54 of the receptacle 50 can also contact the second surface 116 of the card body 110. Therefore, the electronic device 100 and the receptacle 50 do not contact each other at a single point, and the contact points are not arranged on a same line. Accordingly, the electronic device 100 can be firmly secured in the cavity C10 of the receptacle 50. Hence, a reliable electrical connection can be maintained between the terminals 120 of the electronic device 100 and the terminals 52 of the receptacle 50. Moreover, since the electronic device 100 can be firmly secured in the cavity C10 of the receptacle 50, a thickness of the card body 110 does not need to be increased in order to have a reliable electrical connection.

The electronic device 100 provided in the present embodiment is a thin memory card, for example. Therefore, an electronic element 140 is embedded in the card body 110, and the electronic element 140 is electrically connected to the terminals 120. The electronic element 140 is, for example, a memory chip, an input output chip, an integrated circuit control unit, or other electronic elements. In other embodiments, the electronic device 100 may also be a Bluetooth device, a wireless network card, a Global Positioning System (GPS) device, or other electronic device. The first surface 114 and the second surface 116 of the card body 110 according to the present embodiment are substantially planar, for example. Moreover, the stub 130 may also be conformally formed on the card body 110. A USB 2.0/1.1/1.0 standard, for example, is used for the terminals 120 of the electronic device 100 to perform signal transmission with the receptacle 50. Moreover, the terminals 120 of the electronic device 100 are, for example, flat terminals. In other words, an exposed portion of the terminals 120 outside the card body 110 has a flat shape.

Figure 3C:
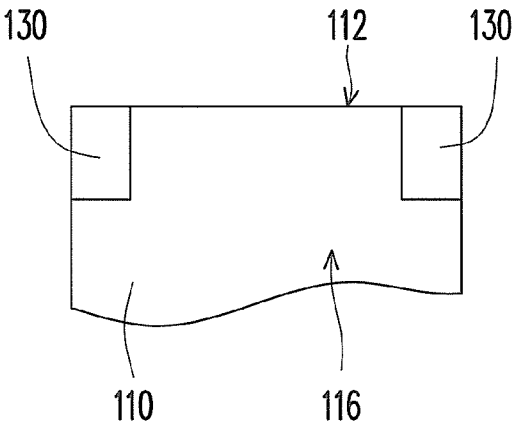
FIGS. 3A-3C illustrate three arrangements of the stub of the electronic device depicted in FIG. 2.
Figure 3B:
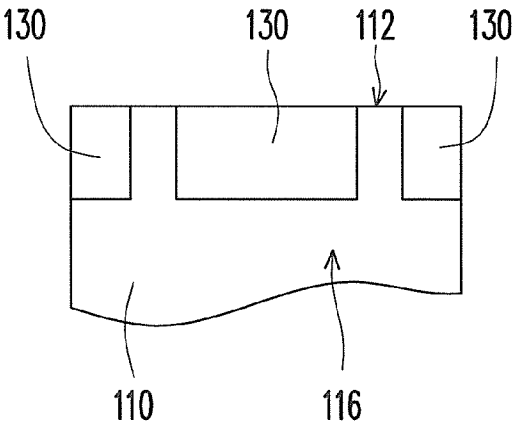
Figure 3A:
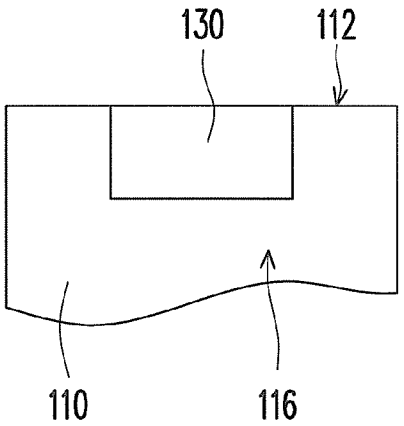

Furthermore, a quantity of the stub 130 may be singular as shown in FIG. 3A. Moreover, due to a stress balance consideration, the stub 130 is disposed in a middle position on the second surface 116 near the front edge 112. Alternatively, the quantity of the stub 130 may also be plural, and the stubs 130 may be arranged as shown in FIG. 3B or 3C. Further, the stub 130 may adopt a design avoiding the orientation spring 54 of the receptacle 50.

Figure 4:
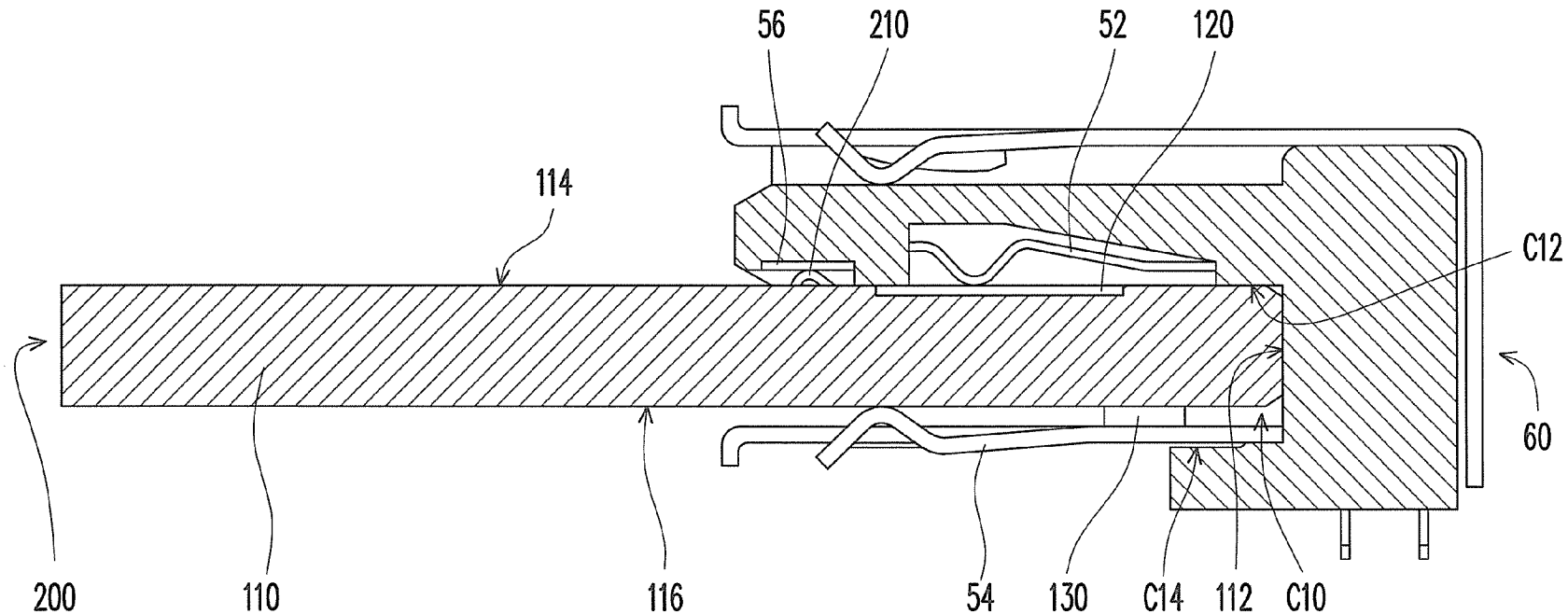
FIG. 4 is a schematic assembly view of an electronic device and a receptacle according to another exemplary embodiment of the disclosure.
Figure 5:
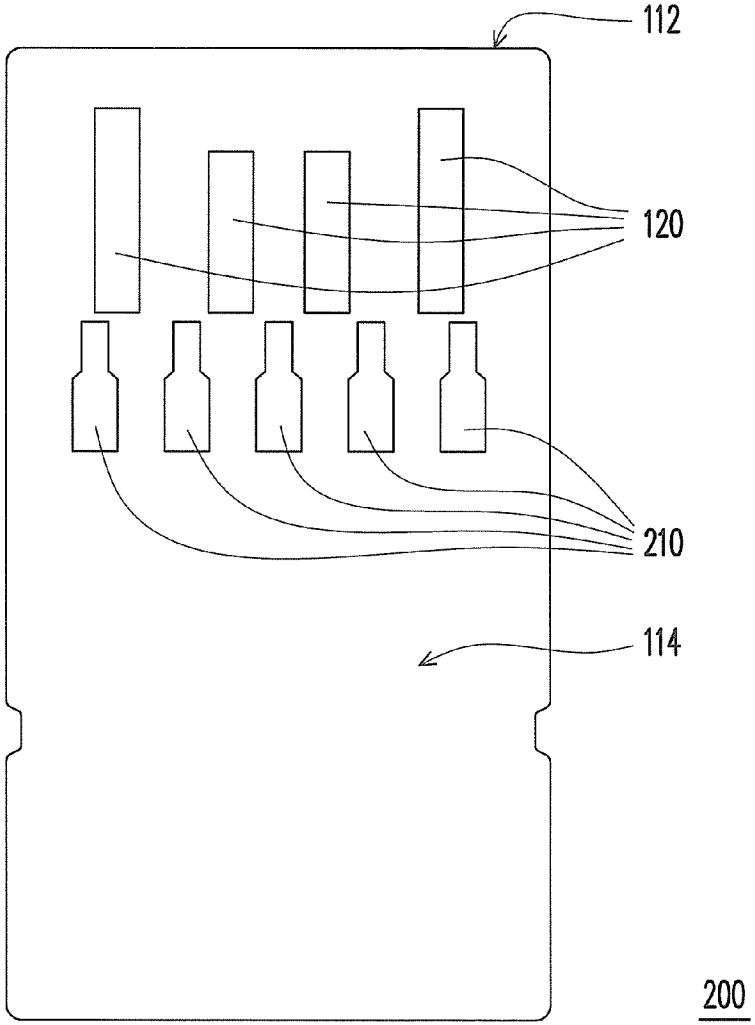
FIG. 5 is a front view of the first surface of the electronic device depicted in FIG. 4.

FIG. 4 is a schematic assembly view of an electronic device and a receptacle according to another exemplary embodiment of the disclosure. FIG. 5 is a front view of the first surface of the electronic device depicted in FIG. 4. Referring to FIGS. 4 and 5, an electronic device 200 provided in the present embodiment is similar to the electronic device 100 depicted in FIG. 2, and a difference therebetween will be illustrated hereinafter. Besides the terminals 120, the electronic device 200 according to the present embodiment further includes a plurality of terminals 210. The terminals 210 are arranged on the first surface 114. More specifically, the terminals 120 are most arranged on a same row, the terminals 210 are also mostly arranged on a same row, and the terminals 120 are disposed between the terminals 210 and the front edge 112. Besides the terminals 52, a receptacle 60 further includes a plurality of terminals 56. The terminals 52 and terminals 56 are disposed on the top wall C12 of the cavity C10. Since the electronic device 200 according to the present embodiment has the stub 130, the electronic device 200 can also be firmly secured in the cavity C10 of the receptacle 50. Moreover, a reliable electrical connection is maintained between the terminals 120 of the electronic device 200 and the terminals 52 of the receptacle 50. Consequently, a reliable electrical connection is also maintained between the terminals 210 of the electronic device 200 and the terminals 56 of the receptacle 50.

A USB standard, for example, is used for the terminals 120 and the terminals 210 of the electronic device 200 in the present embodiment to perform signal transmission with the receptacle 60. The quantity of the terminals 120 is four, and the quantity of the terminals 210 is five. Moreover, the terminals 120 of the electronic device 200 are, for example, flat terminals. In other words, an exposed portion of the terminals 120 outside the card body 110 has a flat shape. The terminals 210 of the electronic device are, for example, elastic terminals. In other words, when an exposed portion of the terminals 210 outside the card body 110 is pressed by an external force, the terminals 210 are elastically deformed. After the external force is removed, the terminals 210 return to an original shape. In principle, a material of the terminals 210 has a conductive property, for example a metal.

Figure 6:
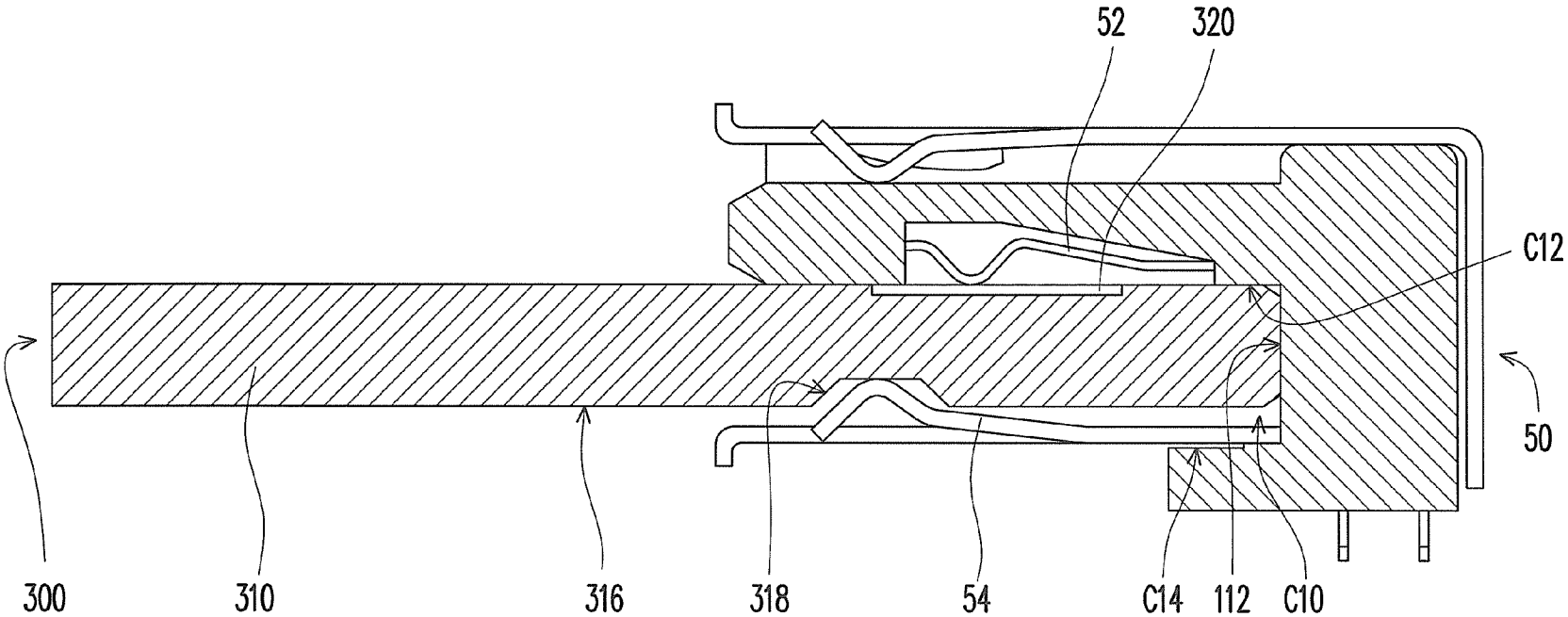
FIG. 6 is a schematic assembly view of an electronic device and a receptacle according to another exemplary embodiment of the disclosure.
Figure 7:
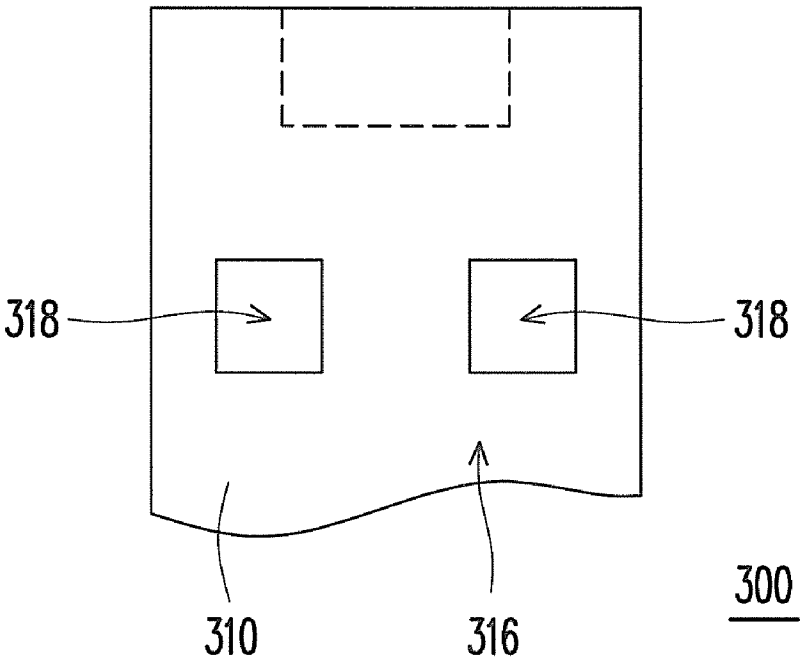
FIG. 7 is a partial schematic view of the second surface of the electronic device depicted in FIG. 6.

FIG. 6 is a schematic assembly view of an electronic device and a receptacle according to another exemplary embodiment of the disclosure. FIG. 7 is a partial schematic view of the second surface of the electronic device depicted in FIG. 6. Referring to FIGS. 6 and 7, an electronic device 300 provided in the present embodiment is similar to the electronic device 100 depicted in FIG. 2, and a difference therebetween will be illustrated hereinafter. The electronic device 300 according to the present embodiment omits the stub 130 depicted in FIG. 2, although a second surface 316 of a card body 310 has at least one locked hole 318. In other embodiments, the electronic device may have both the stub and the locked hole. The recessed portion 318 is disposed corresponding to a position of the orientation spring 54 of the receptacle 50. When the orientation spring 54 of the receptacle 50 is correspondingly disposed on the locked hole 318, the terminals 52 correspondingly contact a plurality of terminals 320. After the electronic device 300 is plugged into the cavity C10 of the receptacle 50, because the locked hole 318 can accommodate the orientation spring 54, the second surface 316 of the card body 310 may possibly contact with the bottom wall C14 of the cavity C10. However, the present embodiment does not require contact between the second surface 316 and the bottom wall C14. Accordingly, the electronic device 300 can be firmly secured in the cavity C10 of the receptacle 50. Hence, a reliable electrical connection can be maintained between the terminals 320 of the electronic device 300 and the terminals 52 of the receptacle 50. Moreover, since the locked hole 318 can accommodate the orientation spring 54, the thickness of the card body 110 may be increased so as to strengthen the card body 110 against bending.

Furthermore, the electronic device 300 provided in the present embodiment may concurrently adopt a stub design, as shown by a dotted line in FIG. 7. A shape and a recessed degree of the locked hole 318 may be adjusted as required, such that when the electronic device 300 is plugged into the cavity C10 of the receptacle 50, the card body 110 and the top wall C1 of the cavity C10 approach a horizontal plane, and the terminals 320 and 52 are properly contacted.

Figure 8A:
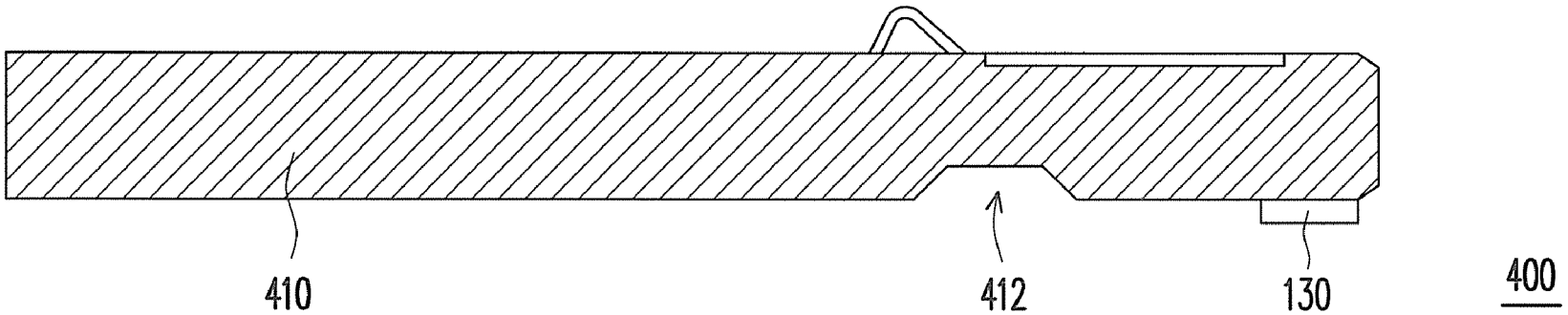
FIG. 8A is a schematic view of an electronic device according to another exemplary embodiment of the disclosure.
Figure 8B:
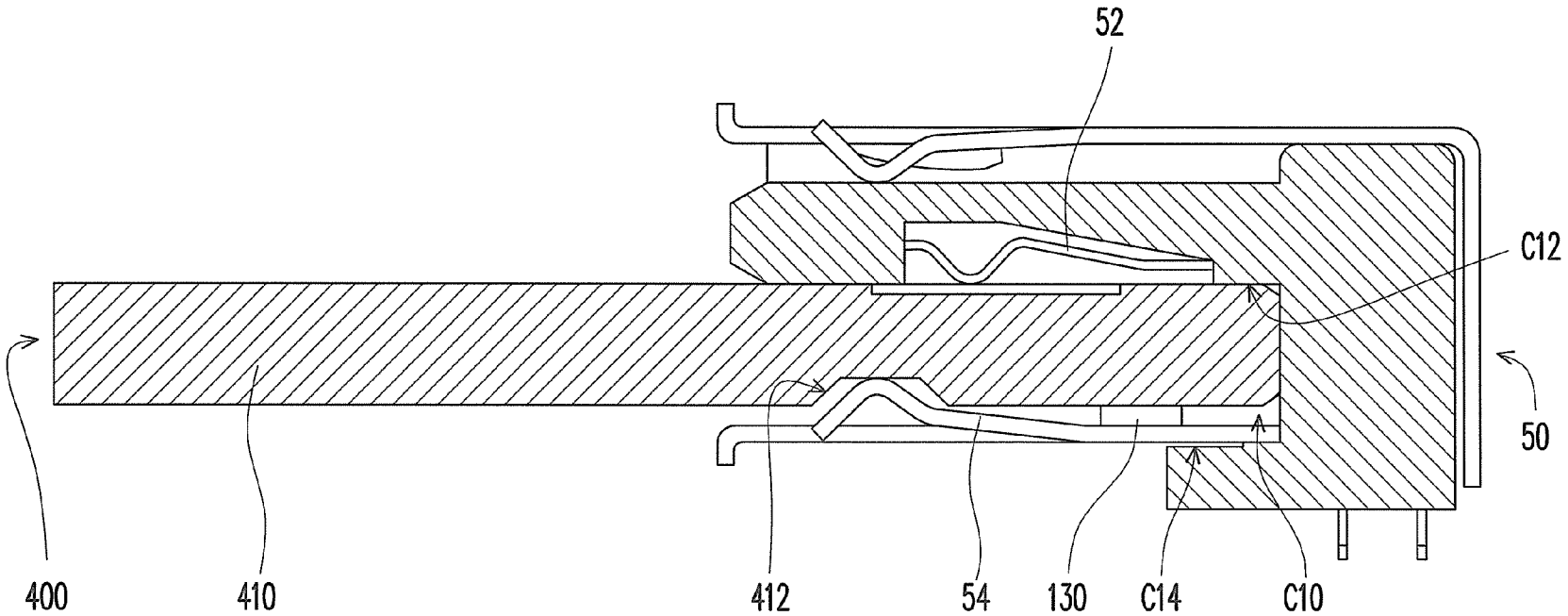
FIG. 8B is a schematic assembly view of the electronic device depicted in FIG. 8A and a receptacle.

FIG. 8A is a schematic view of an electronic device according to another exemplary embodiment of the disclosure. FIG. 8B is a schematic assembly view of the electronic device depicted in FIG. 8A with a receptacle. Referring to FIGS. 8A and 8B, an electronic device 400 provided in the present embodiment is similar to the electronic device 200 depicted in FIG. 4, and a difference is that besides the electronic device 400 having the stub 130, a card body 410 has at least one locked hole 412. The locked hole 412 has a similar function as the locked hole 318 depicted in FIG. 6. Accordingly, the electronic device 400 can be firmly secured in the cavity C10 of the receptacle 50.

Figure 9:
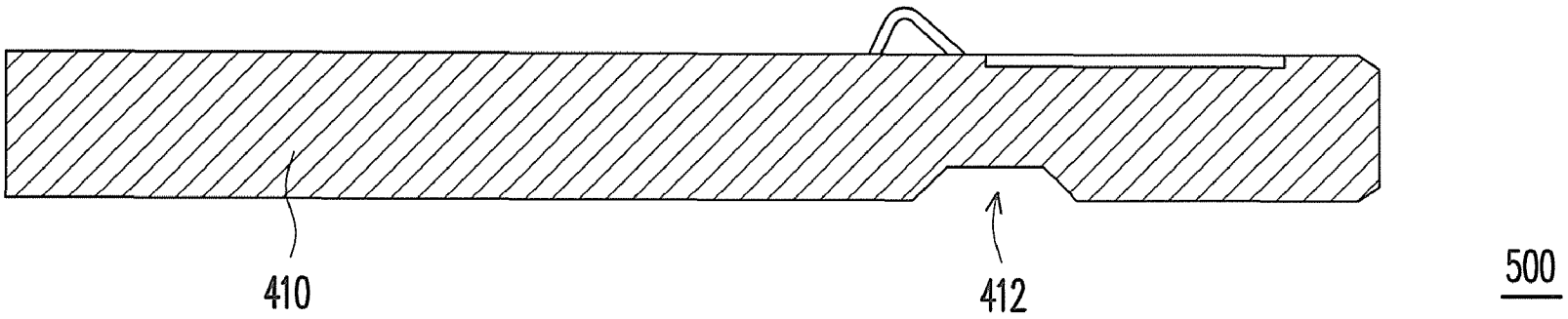
FIG. 9 is a schematic view of an electronic device according to another exemplary embodiment of the disclosure.

FIG. 9 is a schematic view of an electronic device according to another exemplary embodiment of the disclosure. Referring to FIG. 9, an electronic device 500 provided in the present embodiment is similar to the electronic device 400 depicted in FIG. 8A, and a difference is that the electronic device 500 omits the stub 130, such that the card body 410 has merely at least one locked hole 412. Thus, the electronic device 500 can also be firmly secured in the cavity C10 of the receptacle 50 depicted in FIG. 4.

Figure 10A:
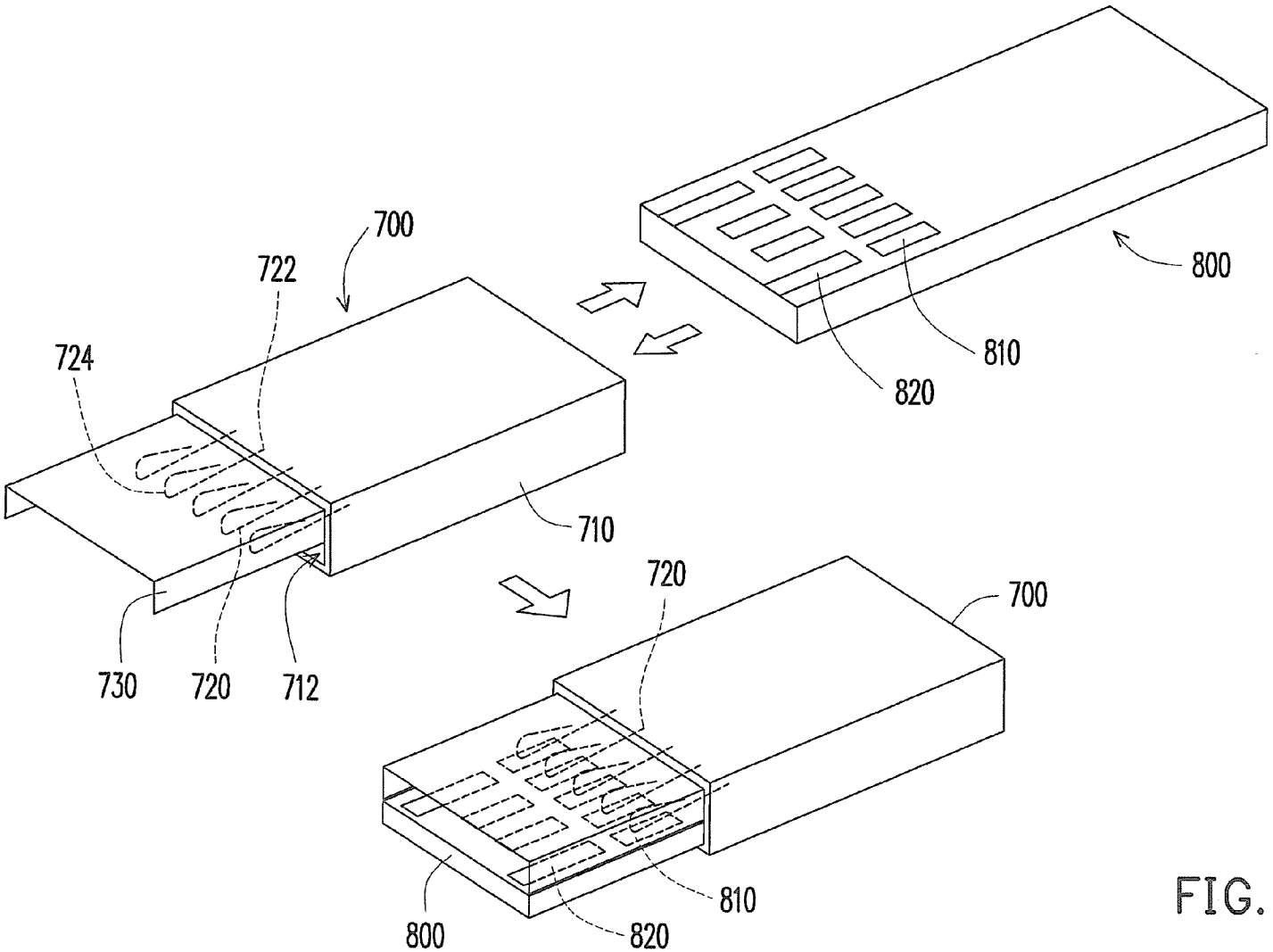
FIG. 10A is a schematic assembly view of an electronic device and an adapter according to an exemplary embodiment of the disclosure.

FIG. 10A is a schematic assembly view of an electronic device and an adapter according to an exemplary embodiment of the disclosure. Referring to FIG. 10A, an adapter 700 provided in the present embodiment includes a body 710 and a plurality of elastic terminals 720. The body 710 has an accommodating portion 712 for accommodating an electronic device 800. One ends 722 of the elastic terminals 720 are fixed (e.g., embedded or fastened) to the body 710, and another ends 724 of the elastic terminals 720 are suspended. Each of the elastic terminals 720 is electrically independent. Due to the viewing angle, the elastic terminals 720 hidden at the bottom of an upper surface of the adapter 700 are represented by dotted lines, so as to provide easier understanding of the position of the elastic terminals 720. When an electronic device 800 is accommodated at the accommodating portion 712, a plurality of flat terminals 810 are disposed outside of the accommodating portion 712, and another ends 724 of the elastic terminals 720 are against the flat terminals 810 correspondingly.

Due to the adapter 700, the electronic device 800 does not require elastic terminals to be equipped therein, since a reliable electrical connection can be established with the receptacle 60 depicted in FIG. 4, for example, through the adapter 700. More specifically, the flat terminals 810 of the electronic device 800 may contact the terminals 56 of the receptacle 60 depicted in FIG. 4 through the elastic terminals 720. Therefore, a simpler process can be adopted to manufacture the electronic device 800 having the flat terminals 810, such that an expensive yet complicated process to manufacture the elastic terminals is not required. When the electronic device 800 needs to satisfy the USB 2.0 specification, only the flat terminals 820 are needed as an additional element. To satisfy the USB 3.0 specification, the flat terminals 810 are needed, in contrast to the electronic device 200 depicted in FIG. 4 requiring the disposition of the terminals 210 of the elastic type. Moreover, the afore-described designs having locked holes and/or stubs as illustrated in each embodiment may be applied in the electronic device 800. When combining the electronic device 800 and the adapter 700, a side of the electronic device 800 having the flat terminals 820 may move towards the adapter 700, as shown by the arrows depicted in FIG. 10A. Alternatively, the electronic device 800 may also move towards the accommodating portion 712 from a side of the adapter 700 having the elastic terminals 720. Further, the electronic device may also be integrated with the adapter 700 from other directions in accordance with a design of the accommodating portion 712. Moreover, the adapter 700 may be suitably designed to orient the electronic device 800. "Orient" herein means a head end of the adapter 700 and the electronic device 800 line up to each other.

Figure 10B:
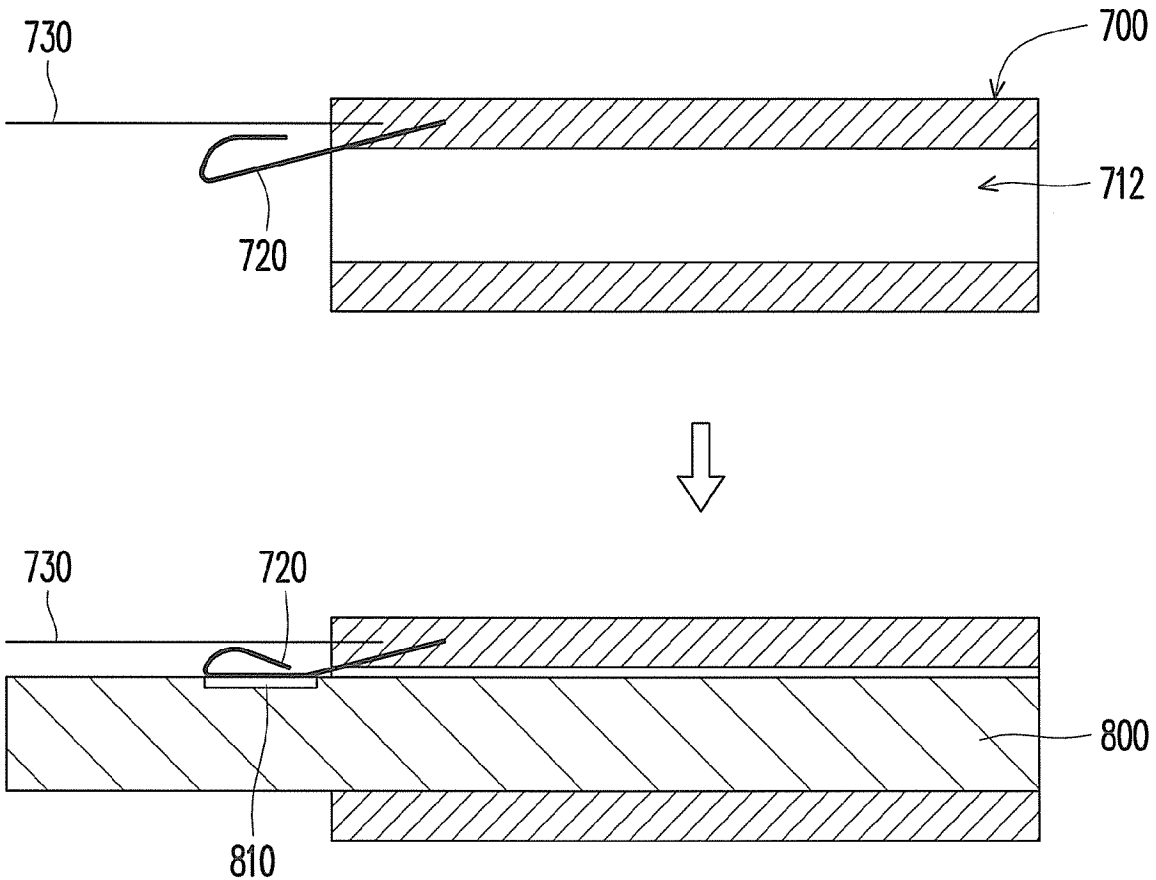
FIG. 10B are schematic cross-sectional views of the electronic device and the adapter depicted in FIG. 10A before and after assembly.
Figure 13B:
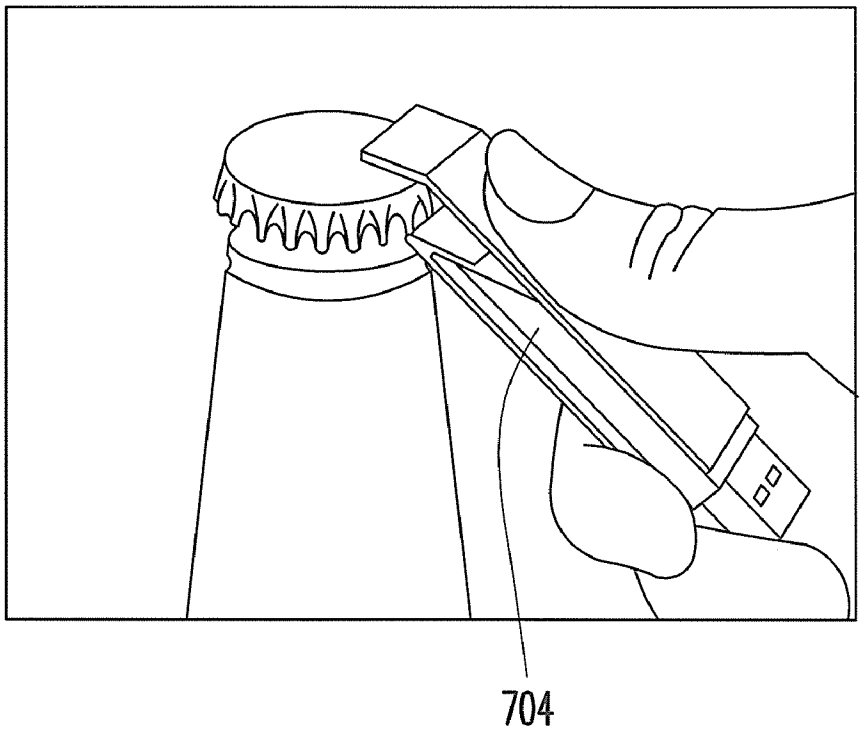
FIGS. 13A and 13B are schematic views of the adapter according to another two exemplary embodiments of the disclosure.
Figure 13A:
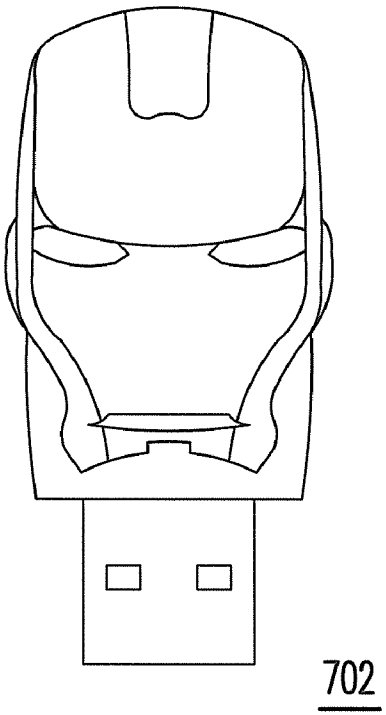

The adapter 700 provided in the present embodiment may further include a cover 730. The cover 730 is extended from the body 710 and fixed on a side having the elastic terminals 720. The cover 730 can provide a suitable protection for the elastic terminals 720. In other words, one ends 722 of the elastic terminals 720 are fixed to the body 710, and another ends 724 of the elastic terminals 720 are suspended under the cover 730. Moreover, when the electronic device 800 and the adapter 700 have been combined and about to be integrated with the receptacle 70 depicted in FIG. 10A, for example, the cover 730 can guide the integration of the three elements and add extra security. Further, a quantity of the elastic terminals 720 according to the present embodiment is five, for example. Additionally, an outer appearance of the adapter 700 does not necessarily have to conform to FIG. 10A. The adapter 700 may have other cosmetic appearances or auxiliary functions, although the internal functions are depicted as in FIG. 10A or 10B. For example, another embodiment of the disclosure provides an adapter 702 having an outer appearance of a cartoon character, as shown in FIG. 13A. Another embodiment of the disclosure provides an adapter 704 having an outer appearance as shown in FIG. 13B. The adapter 704 has an auxiliary function of a can opener.

Figure 11A:
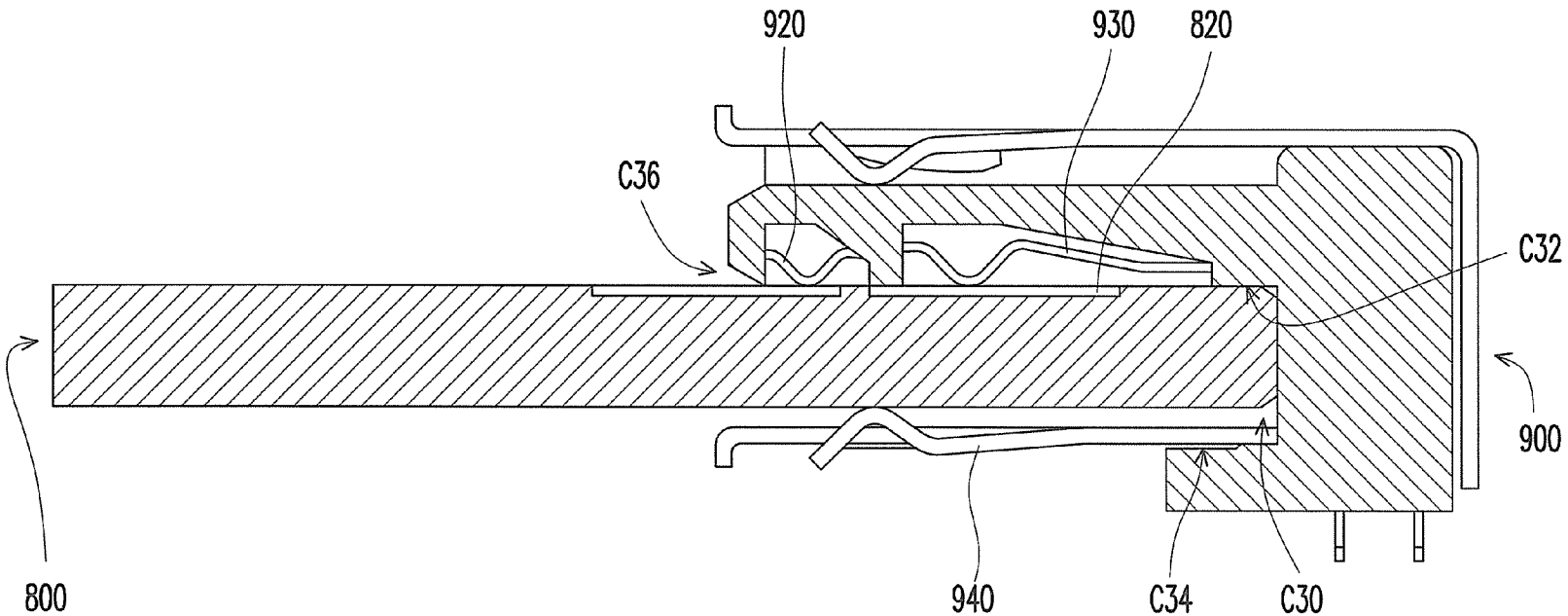
FIGS. 11A-11E are schematic assembly views of the electronic devices and the receptacles according to five exemplary embodiments of the disclosure.
Figure 11B:
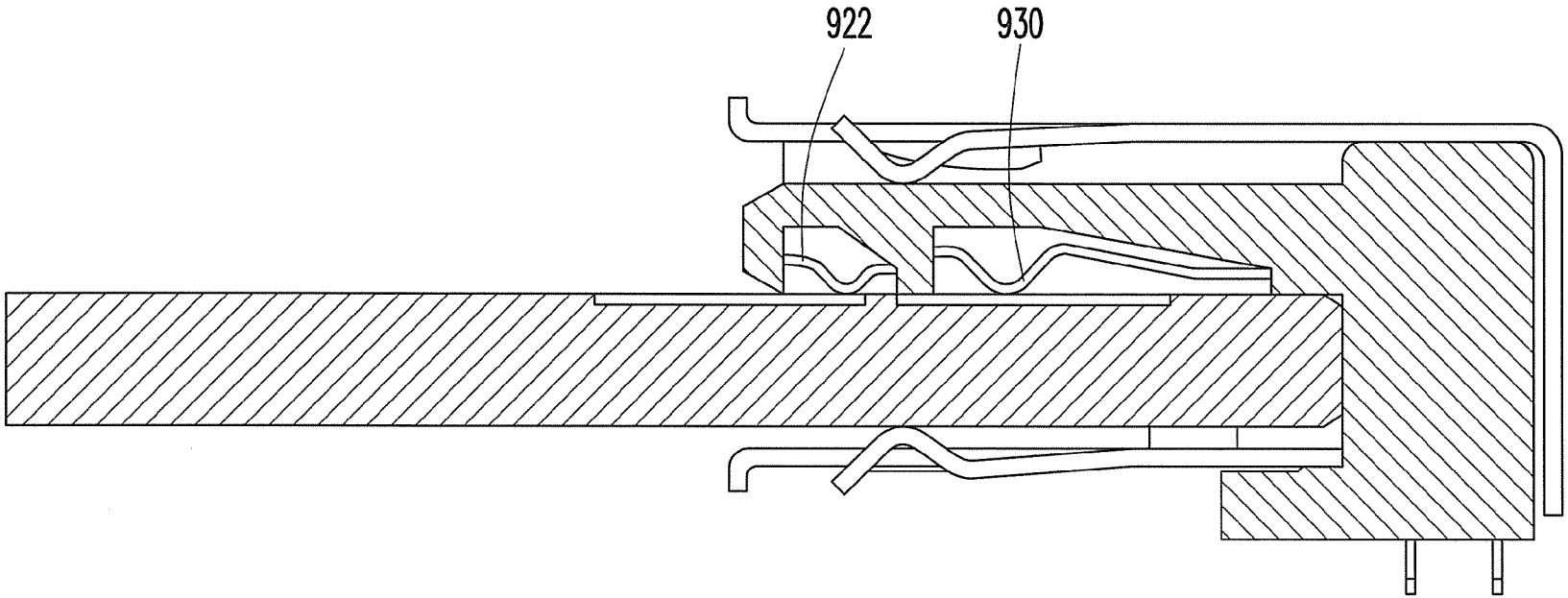
Figure 11C:
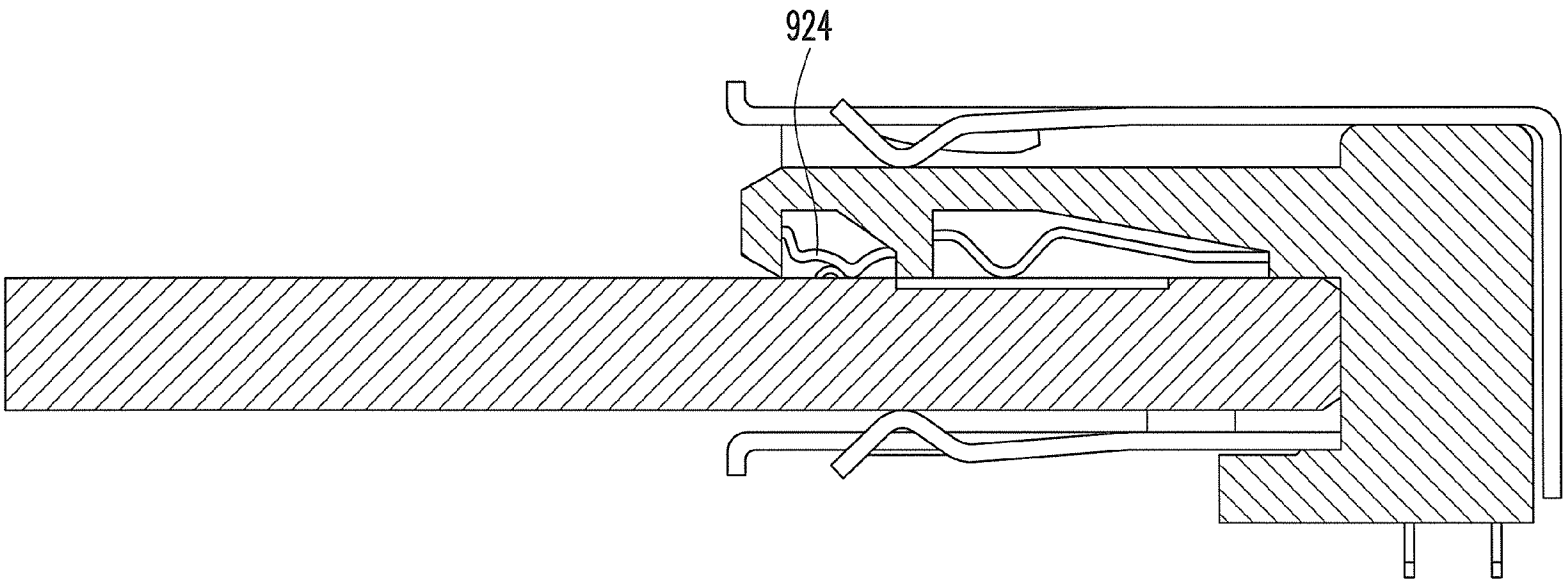
Figure 11D:
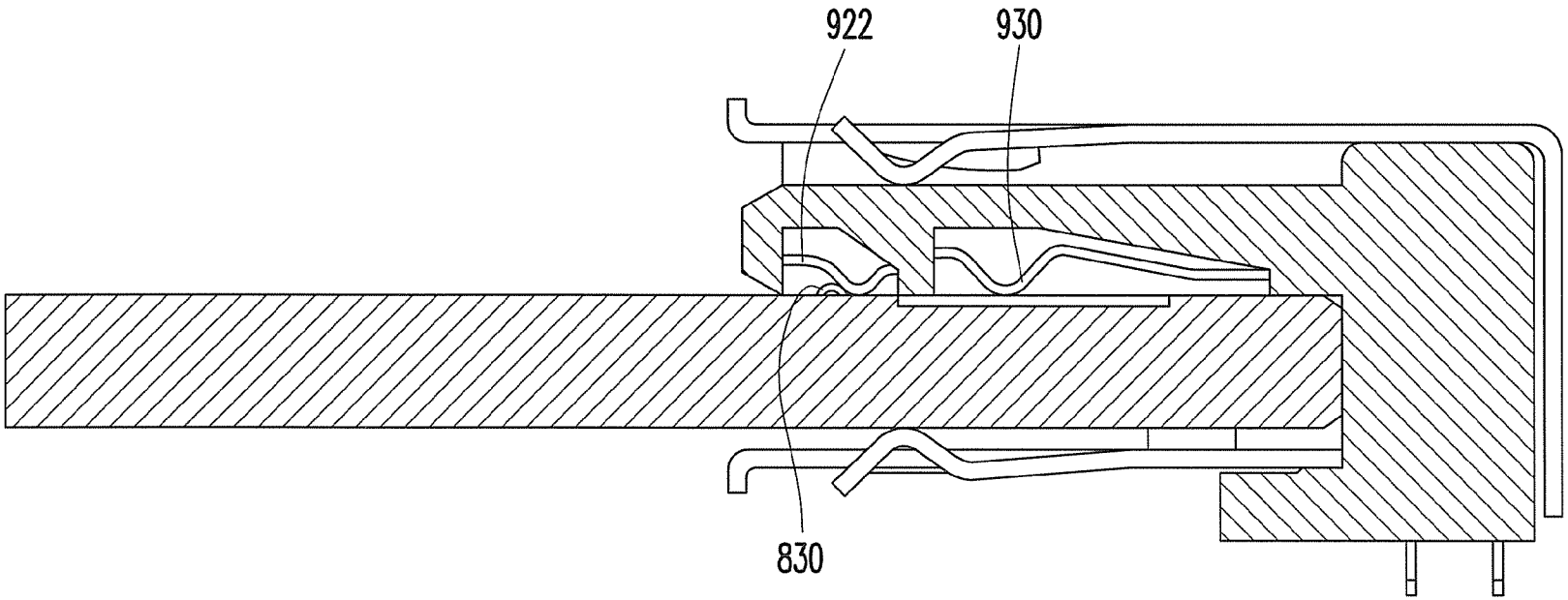
Figure 11E:
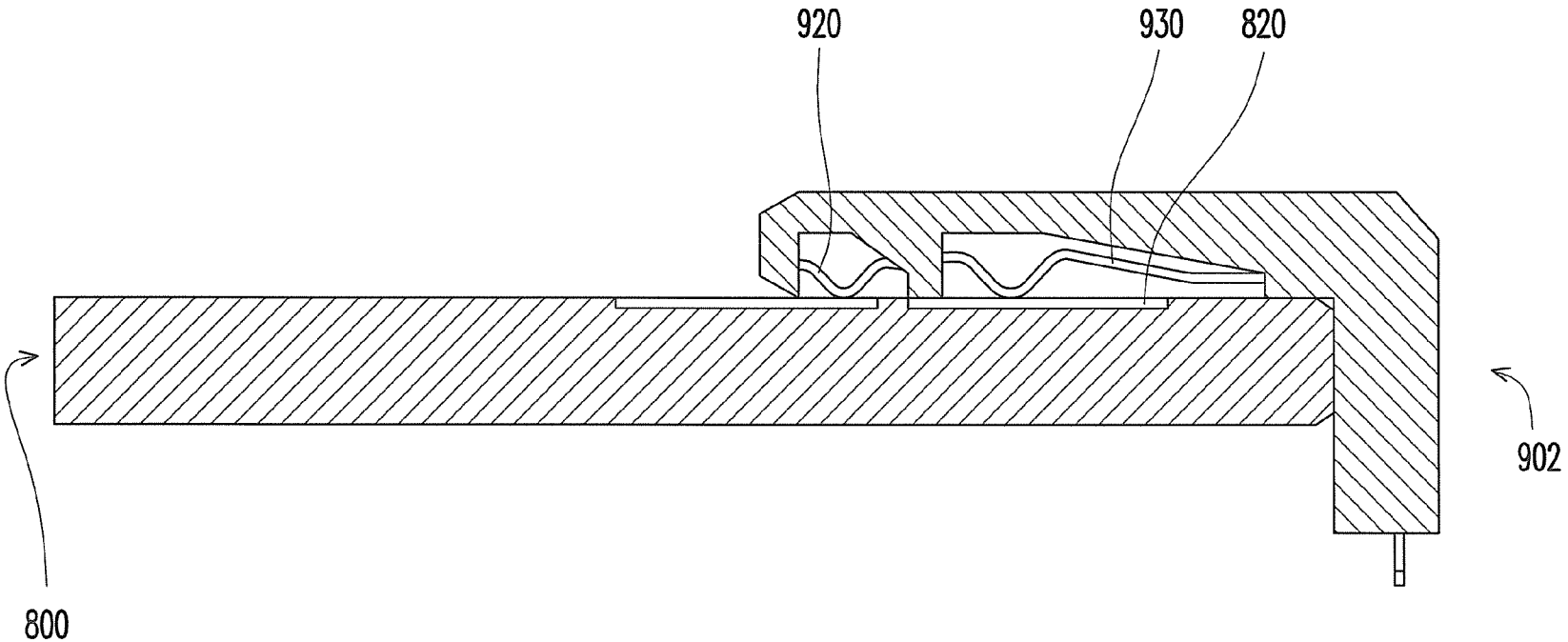
Figure 12:
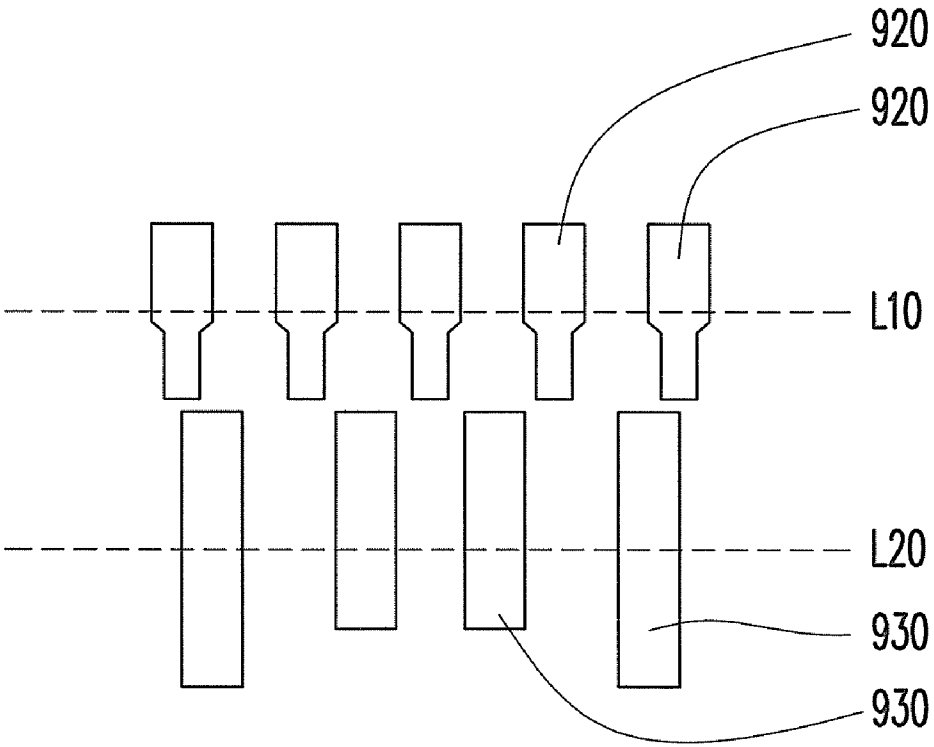
FIG. 12 is a schematic view illustrating an arrangement of the terminals of the receptacle depicted in FIG. 11.

FIGS. 11A-11E are schematic assembly views of the electronic device and the receptacle according to the five exemplary embodiments of the disclosure. FIG. 12 is a schematic arrangement view of the terminals of the receptacle depicted in FIG. 11A. Referring to FIGS. 11A and 12, an adapter 900 provided in the present embodiment includes a body 910, a plurality of elastic terminals 920, and a plurality of elastic terminals 930. A body 910 has a cavity C30. The elastic terminals 920 are arranged as a row L10 on a top wall C32 of the cavity C30. The elastic terminals 930 are arranged as a row L20 on the top wall C32 of the cavity C30, and the row L20 is a different row from the elastic terminals 920.

By the design of the elastic terminals 920 and 930, the adapter 700 depicted in FIG. 10A is not required. With the flat terminals 820 of the electronic device 800, contact with the elastic terminals 930 of the receptacle 900 can be made reliably. Moreover, the flat terminals 810 of the electronic device 800 can also reliably contact with the elastic terminals 920 of the receptacle 900. Additionally, the flat terminals 120 of the electronic device 200 depicted in FIG. 4 can reliably contact the elastic terminals 930 of the receptacle 900, and the elastic terminals 210 of the electronic device 200 can reliably contact the elastic terminals 920 of the receptacle 900. In other words, the receptacle 900 provided in the present embodiment can be integrated with different types of electronic devices to produce reliable combinations, and thus the receptacle 900 has a preferable compatibility property.

Moreover, the elastic terminals 920 provided in the present embodiment are springs as an example, although other suitable designs may be adopted for the elastic terminals 920. In other words, the terminals 920 is pressed by an external force, the terminals 920 are elastically deformed. After the external force is removed, the terminals 920 return to an original shape. Furthermore, a shape of the portion of the elastic terminals 920 contacting the other terminals may be as illustrated in FIG. 11A. Alternatively, an interlaced design of the elastic terminals 922 and 930 shown in FIG. 11B may be adopted. Another option, for instance, is designing the shape of the elastic terminals 924 contacting the other terminals as a W shape, as shown in FIG. 11C (e.g., the design of two troughs may also be sharp or rounded). In FIG. 11D, the elastic terminals 922 are adapted for contacting the spring type terminals 830. The receptacle 900 may further include at least one orientation spring 940 disposed on a bottom wall C34 of the cavity C30, or the orientation spring 940 may be omitted (e.g., only one orientation spring 940 can be seen in FIG. 11A). A quantity of the elastic terminals 930 provided in the present embodiment is four, and a quantity of the elastic terminals 920 is five. The elastic terminals 920 is closer to an entrance C36 of the cavity C30 than the elastic terminals 930.

In the foregoing four exemplary embodiments, the receptacles have orientation springs, although a receptacle according to an embodiment of the disclosure does not necessarily need an orientation spring. For example, on a portable electronic device, a push-push design is typically adopted for the receptacle to omit the orientation spring and thereby decrease bulk, as shown in FIG. 11E. In FIG. 11E, the electronic device 800 employs the flat terminals 820, and a receptacle 902 employs the elastic terminals 930. However, a spring design may be adopted for the flat terminals 820, and a flat design may be adopted for the elastic terminals 930.

In view of the foregoing, an electronic device according to an embodiment of the disclosure has a stub and/or a locked hole, and therefore after connecting with a receptacle, a preferable stress balance can be achieved, thereby preventing disorientation and ensuring a reliable contact with the receptacle. Moreover, the receptacle according to an embodiment of the disclosure provides elastic terminals, hence the electronic device does not require elastic terminals thereon to achieve a preferable compatibility property. Furthermore, the receptacle according to an embodiment of the disclosure employs two types of elastic terminals. Therefore, whether the connected electronic device has elastic terminals or not, the receptacle is compatible whether the electronic device.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An electronic device, comprising:

a card body having a front edge, a first surface, and a second surface opposite to the first surface;

a plurality of first terminals arranged on the first surface and near the front edge;

at least one stub disposed on the second surface and near the front edge;

a plurality of second terminals arranged on the first surface, wherein the first terminals are disposed between the second terminals and the front edge; and two protective plates fixed to two sides of the card body and disposed near the second terminals, wherein the second terminals are elastic terminals, and a height of the protective plates on the first surface is larger or equal to a height of the second terminals on the first surface.

2. The electronic device as claimed in claim 1, wherein the second terminals are flat terminals or elastic terminals.

3. The electronic device as claimed in claim 1, wherein a quantity of the first terminals is four, and a quantity of the second terminals is five.

4. The electronic device as claimed in claim 1, adapted for plugging into a cavity of a receptacle, wherein the receptacle comprises a plurality of third terminals and a plurality of fourth terminals, the third terminals and the fourth terminals are disposed on a top wall of the cavity, the first terminals correspondingly contact the third terminals, and the second terminals correspondingly contact the fourth terminals.

5. The electronic device as claimed in claim 1, wherein the first terminals are flat terminals.

6. The electronic device as claimed in claim 1, further comprising a memory chip, an input output chip, or an integrated circuit control unit embedded in the card body and electrically connected to the first terminals.

7. An electronic device, adapted for plugging into a cavity of a receptacle, wherein the electronic device comprises:

a card body having a front edge, a first surface, and a second surface opposite to the first surface, the second surface having at least one locked hole; and a plurality of first terminals arranged on the first surface and near the front edge, wherein the receptacle comprises a plurality of third terminals and at least one orientation spring, the third terminals are disposed on a top wall of the cavity, the orientation spring is disposed on a bottom wall of the cavity, and when the orientation spring is correspondingly disposed on the locked hole, the first terminals correspondingly contact the third terminals.

8. The electronic device as claimed in claim 7, further comprising a plurality of second terminals arranged on the first surface, wherein the first terminals are disposed between the second terminals and the front edge, the receptacle further comprises a plurality of fourth terminals, the third terminals and the fourth terminals are disposed on the top wall, and when the orientation spring is correspondingly disposed on the locked holes, the second terminals correspondingly contact the fourth terminals.

9. The electronic device as claimed in claim 8, wherein the second terminals are flat terminals or elastic terminals.

10. The electronic device as claimed in claim 8, wherein a quantity of the first terminals is four, and a quantity of the second terminals is five.

11. The electronic device as claimed in claim 8, further comprising two protective plates fixed to two sides of the card body and disposed near the second terminals, wherein the second terminals are elastic terminals, and a height of the protective plates on the first surface is larger or equal to a height of the second terminals on the first surface.

12. The electronic device as claimed in claim 7, wherein the first terminals are flat terminals.

13. The electronic device as claimed in claim 7, further comprising a memory chip, an input output chip, or an integrated circuit control unit embedded in the card body and electrically connected to the first terminals.

14. An electronic device adapted for plugging into a cavity of a receptacle, comprising:

a card body having a front edge, a first surface, and a second surface opposite to the first surface;

a plurality of first terminals arranged on the first surface and near the front edge;

at least one stub disposed on the second surface and near the front edge; and a plurality of second terminals arranged on the first surface, wherein the first terminals are disposed between the second terminals and the front edge, the receptacle comprises a plurality of third terminals, a plurality of fourth terminals, and at least one orientation spring, the third terminals and the fourth terminals are disposed on a top wall of the cavity, the orientation springs are disposed on a bottom wall of the cavity, the second surface of the card body having at least one locked hole, and when the orientation springs are correspondingly disposed on the locked holes, the first terminals correspondingly contact the third terminals, and the second terminals correspondingly contact the fourth terminals.

15. The electronic device as claimed in claim 14, wherein the second terminals are flat terminals or elastic terminals.

16. The electronic device as claimed in claim 14, wherein a quantity of the first terminals is four, and a quantity of the second terminals is five.

17. The electronic device as claimed in claim 14, further comprising two protective plates fixed to two sides of the card body and disposed near the second terminals, wherein the second terminals are elastic terminals, and a height of the protective plates on the first surface is larger or equal to a height of the second terminals on the first surface.

18. The electronic device as claimed in claim 14, wherein the first terminals are flat terminals.

19. The electronic device as claimed in claim 14, further comprising a memory chip, an input output chip, or an integrated circuit control unit embedded in the card body and electrically connected to the first terminals.

20. An electronic device adapted for plugging into a cavity of a receptacle, comprising:

a card body having a front edge, a first surface, and a second surface opposite to the first surface;

a plurality of first terminals arranged on the first surface and near the front edge; and at least one stub disposed on the second surface and near the front edge, wherein the receptacle comprises a plurality of second terminals and at least one orientation spring, the second terminals are disposed on a top wall of the cavity, the orientation springs are disposed on a bottom wall of the cavity, the second surface of the card body having at least one locked hole, and when the orientation springs are correspondingly disposed on the locked holes, the first terminals correspondingly contact the second terminals.

21. The electronic device as claimed in claim 20, wherein the first terminals are flat terminals.

22. The electronic device as claimed in claim 20, further comprising a memory chip, an input output chip, or an integrated circuit control unit embedded in the card body and electrically connected to the first terminals.

* * * * *